US007721905B2

(12) United States Patent
Metzdorf

(10) Patent No.: US 7,721,905 B2
(45) Date of Patent: May 25, 2010

(54) RECEPTACLE LID WITH INTEGRAL WORK SURFACE

(76) Inventor: Michael A. Metzdorf, 3553 Cub Cir., Gainesville, GA (US) 30506

( * ) Notice: Subject to any disclaimer, the term of this patent is extended or adjusted under 35 U.S.C. 154(b) by 668 days.

(21) Appl. No.: 11/175,491

(22) Filed: Jul. 6, 2005

(65) Prior Publication Data

US 2006/0027589 A1 Feb. 9, 2006

Related U.S. Application Data

(60) Provisional application No. 60/599,301, filed on Aug. 5, 2004.

(51) Int. Cl.
*B65D 51/18* (2006.01)

(52) U.S. Cl. ..... 220/254.4

(58) Field of Classification Search ..... 220/254.4, 220/254.3, 254.1, 811, 816, 817, 818, 820, 220/821, 824, 212, 254.6, 822, 810; 215/236, 215/235; 16/224; D9/423, 435, 420; D34/10, D34/8, 7

See application file for complete search history.

(56) References Cited

U.S. PATENT DOCUMENTS

| | | | | | |
|---|---|---|---|---|---|
| 217,461 | A * | 7/1879 | Hawkins | 220/818 |
| 1,028,499 | A * | 6/1912 | Schott | 220/816 |
| 1,642,138 | A * | 9/1927 | Billings | 220/291 |
| 1,683,383 | A * | 9/1928 | Chapel | 220/291 |
| 2,631,613 | A * | 3/1953 | Bergstrom | 251/279 |
| 3,197,060 | A * | 7/1965 | Farniok et al. | 220/814 |
| 4,779,754 | A * | 10/1988 | Ten Eyck et al. | 220/254.1 |
| 5,211,289 | A * | 5/1993 | Matthews | 206/508 |
| 5,531,541 | A * | 7/1996 | Clover et al. | 404/25 |
| 5,642,824 | A * | 7/1997 | Hess et al. | 215/235 |
| 6,152,320 | A * | 11/2000 | Hierzer et al. | 220/838 |
| 6,886,713 | B1 * | 5/2005 | Scherrer | 220/817 |
| 2005/0244227 | A1 * | 11/2005 | Akkala et al. | 404/25 |

* cited by examiner

*Primary Examiner*—Anthony Stashick
*Assistant Examiner*—Robert J Hicks
(74) *Attorney, Agent, or Firm*—Gardner Groff Greenwald & Villanueva, PC

(57) ABSTRACT

A lid device for use with a container includes a lid, a frame, and a two-axis pivot coupling connecting the lid to the frame. The frame is mounted to or otherwise connected to the container rim. The lid has a substantially flat and rigid work surface on which a workpiece can be placed. A user can pivot the lid about a first axis to laterally offset the lid from the central opening by a desired amount. With the lid in such an offset position, the user can access the container to, for example, discard waste materials, without having to remove a workpiece resting on the work surface. The greater the amount by which the user offsets the lid, the greater the amount of the container opening that is accessible. A user can also pivot the lid about a second axis to swing the lid open and closed if, for example, the user desires greater access to the container and no workpiece is resting on the work surface.

6 Claims, 2 Drawing Sheets

RECEPTACLE LID WITH INTEGRAL WORK SURFACE

CROSS-REFERENCE TO RELATED APPLICATION

The benefit of the filing date of U.S. Provisional Patent Application Ser. No. 60/599,301, filed Aug. 5, 2004, is hereby claimed.

BACKGROUND OF THE INVENTION

1. Field of the Invention

The present invention relates generally to portable work surfaces and to lids for refuse receptacles and the like.

2. Description of the Related Art

Mechanics, machinists, manufacturers, hobbyists and others often keep a refuse receptacle near their workbench or other work surface while they work on mechanical parts or similar articles. For example, a mechanic working on an assembly undergoing maintenance or repair may need to dispose of dirt particles cleaned from it or small worn parts being replaced in it. Similarly, in some instances, the work may involve removing material from a workpiece using hand or power tools. Having a refuse receptacle close at hand is important because waste material can be spilled on the floor or on articles while carrying it to the receptacle. Such spills take time and effort to clean up. They can also be hazardous to the environment and damaging to flooring or other articles.

It is known for mechanics to use a device commonly referred to as a parts cleaner to clean dirt particles from a part or assembly. A parts cleaner has a draining surface upon which the part can be placed while a cleaning solution is pumped through a nozzle directed at the part. Dirty solution drains into a tank or receptacle. Parts cleaners are intended only for cleaning parts, as their surfaces are not conveniently configured for doing anything else to the part. Also, parts cleaners are not refuse containers and cannot accept larger pieces of waste. Therefore, any large particles or pieces removed from the part must be taken to a separate refuse receptacle for disposal.

Trash cans have been used as makeshift supports for various articles. For example, it is known that common plastic or galvanized steel trash cans having a capacity typically in the range of 25-50 gallons and commonly used to dispose of household and garden waste, can be used as makeshift sawhorses to facilitate cutting a piece of lumber, tree branch, etc. The wood can be laid across one or two such trash cans (without lids), and the waste tossed in the can. Although this method works in a pinch, an open trash can is far from a stable, convenient work surface.

It would be desirable to provide a convenient and efficient means for a person to dispose of waste while working on a part or other object. The present invention addresses these problems and deficiencies and others in the manner described below.

SUMMARY OF THE INVENTION

The present invention relates to a lid device for a container having a rim, such as a trash can or other receptacle. The lid device comprises a lid, a frame, and a two-axis pivot coupling connecting a portion of the lid to a portion of the frame. The frame is mounted to the rim, integrally formed with the rim, or otherwise connected to the rim prior to use. The frame has a central opening for accessing the container. The lid has a substantially flat and rigid work surface and a size and shape substantially corresponding to a size and shape of the central opening so as to cover the central opening when the lid is in a closed position. A user can pivot the lid about a first axis to laterally offset the lid from the central opening by a desired amount. With the lid in such an offset position, the user can access the container to, for example, discard waste materials, without having to remove a workpiece resting on the work surface. The greater the amount by which the user offsets the lid, the greater the amount of the container opening that is accessible. A user can also pivot the lid about a second axis to swing the lid open and closed if, for example, the user desires greater access to the container and no workpiece is resting on the work surface.

DETAILED DESCRIPTION

Figure 1:
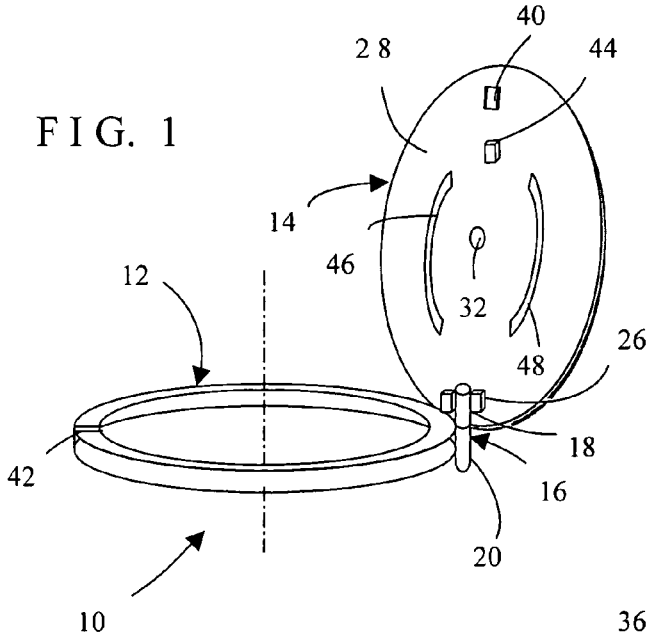
FIG. 1 is a perspective view of a lid device, showing the lid swung vertically to an open position.
Figure 3:
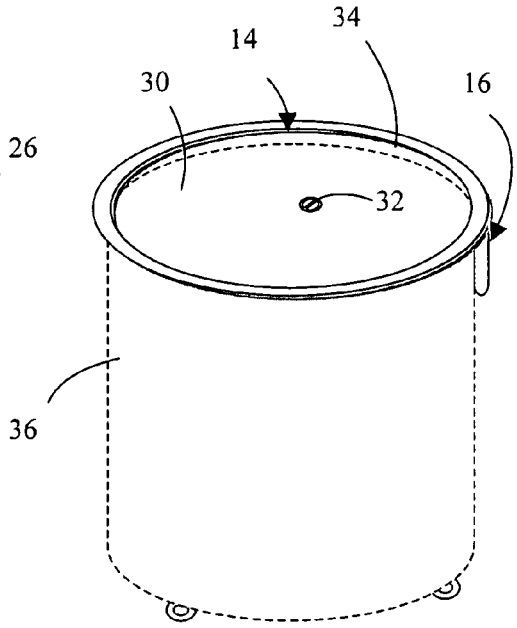
FIG. 3 is a perspective view of the lid device mounted on a trash container, showing the lid in a completely closed position.

In the following description, like reference numerals indicate like components to enhance the understanding of the invention through the description of the drawings. Also, although specific features, configurations, arrangements and steps are discussed below, it should be understood that such specificity is for illustrative purposes only. A person skilled in the relevant art will recognize that other features, configurations, arrangements and steps are useful without departing from the spirit and scope of the invention.

As illustrated in FIGS. 1-6, a device 10 in accordance with an exemplary embodiment of the present invention comprises a frame 12 having a central opening, a lid 14, and a two-axis pivot coupling 16. Pivot coupling 16, shown in further detail in FIGS. 5-6, comprises a first pivot pin 18, a first pivot socket or sleeve 20, a collar 22, and a second pivot pin 24. First pivot pin 18 is received in and pivots freely within first pivot sleeve 20, which is connected to frame 12. Second pivot pin 24 is received in and pivots freely within a bore in the upper end of first pivot pin 18 (see FIG. 5). The ends of second pivot pin 24 are respectively received in two opposing brackets 26, which are connected to the underside or reverse face 28 of lid 14.

The top or obverse face 30 of lid 14 is substantially flat and serves as a work surface. Lid 14 is sufficiently strong and rigid to allow objects, such as mechanical parts and other workpieces, to be placed upon face 30. In this regard, essentially the entire device 10, or at least frame 12 and lid 14, can be made of a strong, rigid thermoplastic material, such as high-density polyethylene. Although not shown for purposes of clarity, reverse face 28 of lid 14 can have a lattice-like, honeycomb-like, or other arrangement of reinforcing ribs to enhance strength and rigidity. Nevertheless, persons skilled in the art will appreciate that in other embodiments of the invention the lid can have any other suitable structure and be made of any other suitable materials. The material can be one that is resistant to damage from oil and other common lubricants and machine fluids. Features of the illustrated embodiment of the invention also include a removable drain plug 32 in face 30. A raised rim 34 around face 30 helps contain spills of any such fluids and prevent loose particles or small parts from falling off face 30.

In the illustrated embodiment of the invention, frame 12 comprises an annular U-section channel that is mountable on the rim of an open container 36, as shown in FIGS. 2-6. Frame 12 is retained in place by the friction-fit of the rim within the channel. The weight of frame 12 resting on the rim also helps maintain it in place. Mounted in this manner, device 10 is ready for use, as described below. In other embodiments of the invention, the frame can have any other suitable shape, such as rectangular, etc., and any other suitable structure. In such embodiments, the means for mounting device 10 on container 36 can be separate from frame 12 or in addition to frame 12. For example, clamps or bands can be included.

Container 36 can be a common trash can (also known variously as a garbage can, refuse can, rubbish can, waste bin, etc.) of the plastic or galvanized steel variety having a capacity typically in the range of 25-50 gallons that is commonly used to dispose of household and garden refuse. Nevertheless, in other embodiments of the invention, container 36 can be any other suitable type of receptacle or other container, such as a metal or plastic 55 gallon drum or other standard size drum. Although many household trash cans and similar receptacles are typically sold by their manufacturers with lids (not shown), device 10 is used in place of any other lid that may be provided by the manufacturer. A user can purchase device 10 to use with a separately purchased container 36, or alternatively, device 10 can be sold along with container 36 as a container-and-lid unit. Indeed, in still other embodiments, the device of the present invention or a portion thereof can be integrally formed with or otherwise connected to a container.

Figure 5:
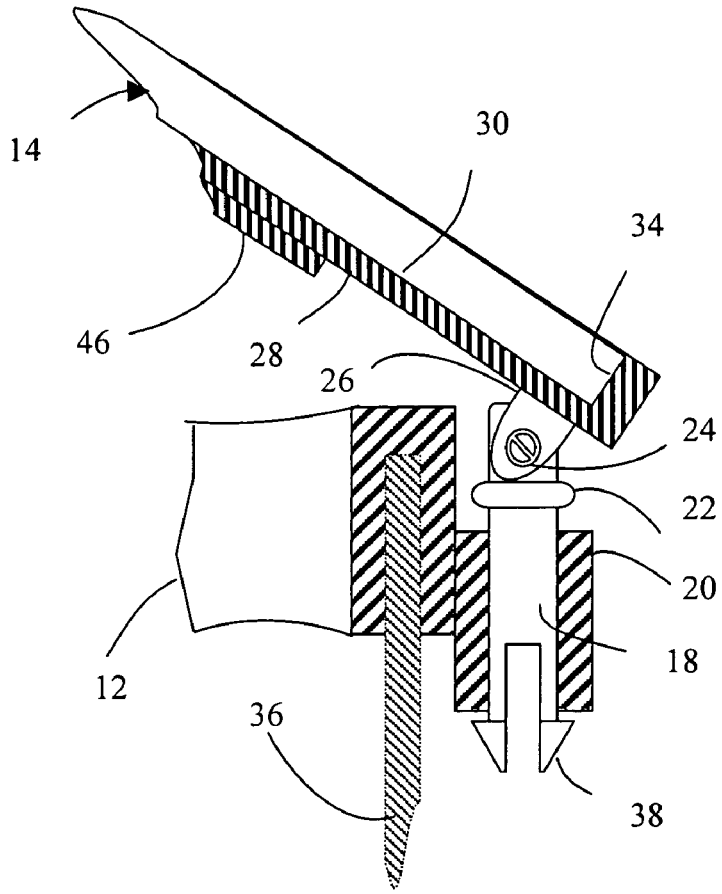
FIG. 5 is a partial cross-sectional view of the pivot coupling portion of the device, showing the lid in a partially open position.
Figure 6:
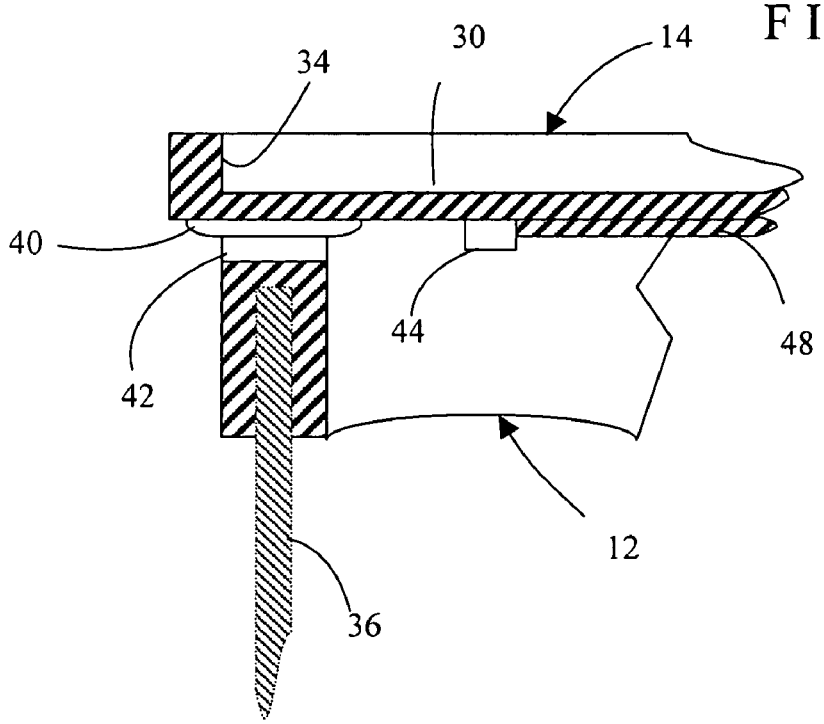
FIG. 6 is a partial cross-sectional view of another portion of the lid device, with the lid in a completely closed position.

It should be noted that lid 14 is removable or detachable from frame 12. To detach lid 14, one lifts it vertically until first pivot pin 18 is disengaged from first pivot sleeve 20. As shown in FIG. 5, retaining barbs 38 may be included that one must pinch before first pin 18 can be removed. To attach lid 14, one lowers lid 14 toward frame 12 such that first pivot pin 18 is received in first pivot sleeve 20. Retaining barbs 38 snap into place when first pivot pin 18 is seated in first pivot sleeve 20. Collar 22 limits the downward travel of first pivot pin 18 within first pivot sleeve 20. Note that a garbage can liner or bag (not shown) can easily be installed by removing the entire device 10 from container 36, inserting the bag, and re-mounting device 10. With the mouth of the bag overlapping the rim of container 36, fitting frame 12 over the bag and rim as described above will securely hold the bag in place.

Figure 2:
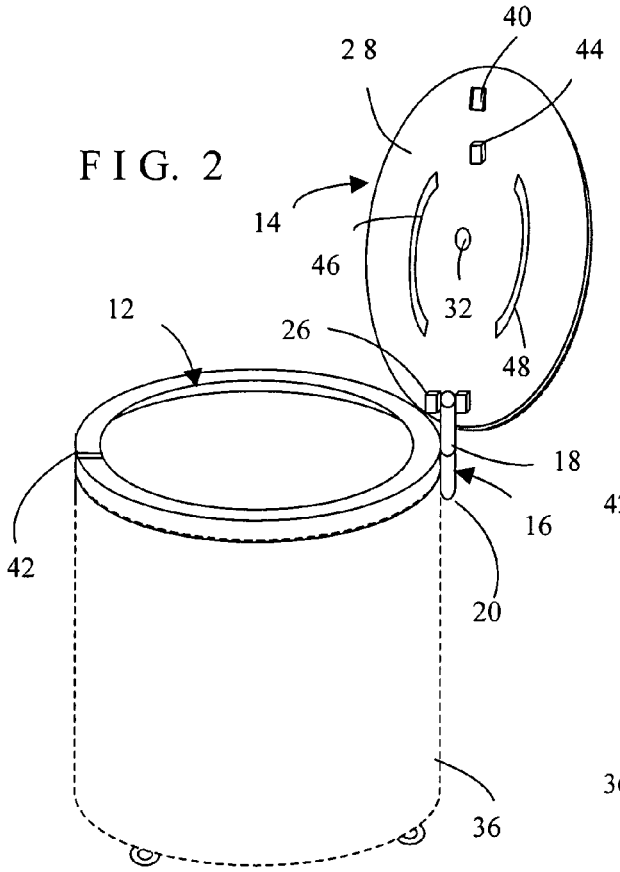
FIG. 2 is a perspective view similar to FIG. 1, showing the lid device mounted on a trash container.
Figure 4:
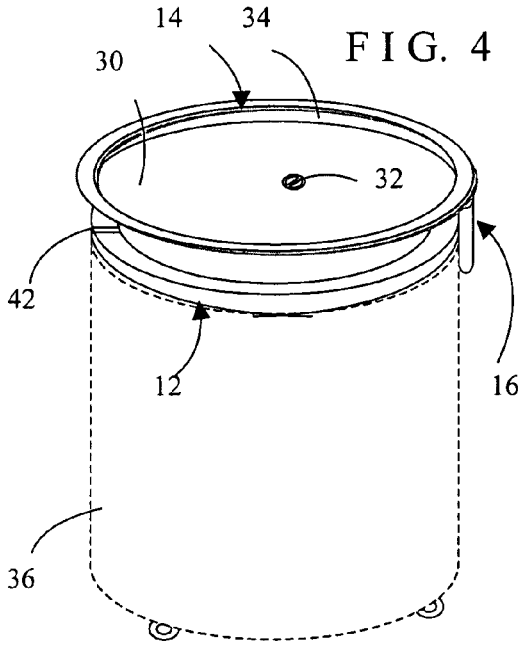
FIG. 4 is a perspective view of the lid device mounted on a trash container, showing the lid pivoted laterally to a partially open position.

A user can open lid 14 in two different ways: Lid 14 can be pivoted laterally on a first pivot axis defined by first pivot pin 18 pivoting within first pivot sleeve 20, and lid 14 can be swung on a second pivot axis defined by second pivot pin 24 pivoting within the bore in first pivot pin 18. Note that the first pivot axis is parallel to the central axis of frame 12 (see FIG. 1), and the second pivot axis is perpendicular to the first pivot axis. FIGS. 1-2 show lid 14 swung open on the second pivot axis. FIG. 4 shows lid 14 pivoted laterally to a partially open position. In such a position, a user can work on a part or other workpiece (not shown) resting on face 30 while accessing the interior of container 36. A user can thus dispose of waste without having to remove the part from face 30 or leave the work area. Also note that lid 14 can be moved from the fully closed position (see FIG. 3) to a position (not shown) in which it hangs vertically alongside container 36 by first pivoting it 180 degrees on the first axis and then swinging it 90 degrees downward. Hanging in such a position, the user has complete access to container 36. (Alternatively, a user can detach lid 14 entirely, as described above.) For stability, if lid 14 is not first pivoted 180 degrees on the first axis, its range of motion is limited to 90 degrees (i.e., the position shown in FIGS. 1-2), as collar 22 acts as a stop when contacted by the edge of lid 14 (see FIG. 5).

As best illustrated in FIGS. 1-2, reverse face 28 of lid 14 also includes a primary pivot stop 40 positioned to engage a shallow retainer slot 42 in frame 12 in a detent-like manner. When pivot stop 40 is engaged in retainer slot 42 (see FIG. 6), lid 14 cannot be moved laterally until the user lifts lid 14 just enough to disengage it from slot 42. Reverse face 28 further includes secondary pivot stops 44, 46 and 48, which are positioned to engage the inner surface of frame when lid 14 is moved laterally, thereby stopping lid 14 from being moved laterally to a more extreme position that might be unstable.

As described above, with lid 14 in the fully closed position (see FIGS. 3 and 6), it can be used as a work surface for repairing, cleaning, assembling or performing other tasks upon a workpiece. Drain plug 32 can be removed to allow any waste fluids to drain into container 36. With lid 14 in a partially open position (see FIG. 4), a user can work on the workpiece while maintaining (limited) access to container 36. With lid 14 in a fully open position (see FIG. 2) or detached from frame 12, the user has full access to container 36.

It will be apparent to those skilled in the art that various modifications and variations can be made to this invention without departing from the spirit or scope of the invention. Thus, it is intended that the present invention covers the modifications and variations of this invention provided that they come within the scope of any claims and their equivalents. For example, although in the illustrated embodiment of the invention the container is a trash can or similar receptacle, in other embodiments it can be, for example, a storage bin for raw materials or parts used in a preparation, assembly, finishing or other process step performed on the work surface or elsewhere. With regard to the claims, no claim is intended to invoke the sixth paragraph of 35 U.S.C. Section 112 unless it includes the term "means for" followed by a participle.

What is claimed is:

1. A lid device for a container having a rim, comprising:

a frame mountable on the rim and having a central opening for accessing the container;

a lid having a substantially flat and rigid work surface and a size and shape substantially corresponding to a size and shape of the central opening; and a two-axis pivot coupling connecting a portion of the lid to a portion of the frame, the pivot coupling including a first pin having a first axis substantially parallel to a central axis of the mounting frame and about which the lid is pivotable to laterally offset the lid from the central opening of the mounting frame by a selectable amount, the pivot coupling including a second pin having a second axis substantially perpendicular to the central axis of the frame and about which the lid is pivotable to swing the lid toward and away from the central opening of the frame;

wherein the first pin includes a bore through an upper end thereof and the second pin is received in and pivots within the bore of the first pin.

2. The lid device claimed in claim 1, wherein the frame has a channel mountable on the rim of the container.

3. The lid device claimed in claim 1, wherein the lid is pivotable to a position hanging parallel to a side of the container.

4. The lid device claimed in claim 1, wherein a first portion of the pivot coupling is attached to the lid and a second portion of the pivot coupling is attached to the frame, the first portion of the pivot coupling includes the first pin and the second portion has a sleeve in which the first pin is releaseably and reuseably received therein, whereby the lid and first pin are selectively detachable from the frame and sleeve.

5. The lid device claimed in claim 1, wherein the lid has a drain.

6. The lid device claimed in claim 1, wherein the lid is made of a material resistant to damage from oils and caustics.

* * * * *